US009091181B2

(12) United States Patent
Roge et al.

(10) Patent No.: US 9,091,181 B2
(45) Date of Patent: Jul. 28, 2015

(54) MODULE FOR A STEAM TURBINE

(75) Inventors: Julien Roge, Clichy (FR); Jacques Mizera, Pierrefonds (FR)

(73) Assignee: ALSTOM TECHNOLOGY LTD., Baden (CH)

( * ) Notice: Subject to any disclaimer, the term of this patent is extended or adjusted under 35 U.S.C. 154(b) by 797 days.

(21) Appl. No.: 13/327,913

(22) Filed: Dec. 16, 2011

(65) Prior Publication Data

US 2012/0163968 A1 Jun. 28, 2012

(30) Foreign Application Priority Data

Dec. 24, 2010 (FR) ..... 10 61236

(51) Int. Cl.
*F01D 25/24* (2006.01)
*F01D 25/26* (2006.01)
*F01D 25/28* (2006.01)

(52) U.S. Cl.
CPC ..... *F01D 25/24* (2013.01); *F01D 25/26* (2013.01); *F01D 25/28* (2013.01); *F05D 2260/30* (2013.01)

(58) Field of Classification Search
CPC ..... F01D 25/24; F01D 25/28; F01D 25/26; F04D 29/601
USPC ..... 415/126, 213.1, 220; 416/244 R, 244 A
See application file for complete search history.

(56) References Cited

U.S. PATENT DOCUMENTS

| | | | | |
|---|---|---|---|---|
| 3,881,843 | A * | 5/1975 | Meylan | 415/213.1 |
| 6,793,458 | B2 * | 9/2004 | Kawai et al. | 415/213.1 |
| 7,267,319 | B2 | 9/2007 | Vitrone | |
| 7,572,112 | B2 * | 8/2009 | Markle | 417/360 |
| 2004/0156720 | A1 | 8/2004 | Lathrop et al. | |
| 2008/0213091 | A1 | 9/2008 | Lageder et al. | |
| 2012/0163968 | A1 | 6/2012 | Roge et al. | |

FOREIGN PATENT DOCUMENTS

| | | | |
|---|---|---|---|
| CN | 100572888 | C | 12/2009 |
| CN | 202081923 | U | 12/2011 |
| DE | 102008000284 | A1 | 9/2008 |
| EP | 0893578 | A1 | 1/1999 |
| GB | 1 205 912 | A | 9/1907 |
| JP | 2001-200706 | A | 7/2001 |

OTHER PUBLICATIONS

First Office Action issued Aug. 26, 2014 in corresponding Chinese Patent Application No. 201110103864.2 and an English translation thereof.

* cited by examiner

*Primary Examiner* — Edward Look
*Assistant Examiner* — Christopher J Hargitt
(74) *Attorney, Agent, or Firm* — Buchanan Ingersoll & Rooney PC

(57) ABSTRACT

Module for a steam turbine including a low-pressure module, includes an internal turbine casing able to accommodate at least one set of fixed vanes and a rotor equipped with at least one set of blades, and a slab, the internal turbine casing resting on the slab via at least two bearers secured to said internal turbine casing, the connection between said bearers and the slab is provided by a plurality of mechanical connectors. The connectors each prevent the internal turbine casing from lifting in relation to the slab, and allow the internal turbine casing to slide on the slab.

20 Claims, 4 Drawing Sheets

MODULE FOR A STEAM TURBINE

RELATED APPLICATION

The present application hereby claims priority under 35 U.S.C. Section 119 to French Patent application number 1061236, filed Dec. 24, 2010, the entire contents of which are hereby incorporated by reference.

FIELD OF THE INVENTION

The subject of the present invention is a module for a steam turbine.

BACKGROUND

A steam turbine is a rotary machine intended to convert the thermal energy in steam into mechanical energy in order to drive an alternator, a pump or any other rotary mechanical receiver. The turbine generally comprises a high-pressure module, possibly a medium-pressure module, and at least one low-pressure module. Steam supplied by a steam generator is conveyed to the high-pressure module then to the medium-pressure and low-pressure modules. The steam exhausted from the low-pressure modules is directed to a condenser, generally situated underneath the low-pressure modules. The remainder of the description is devoted to a device for a low-pressure module.

With reference to FIG. 1, which schematically illustrates, according to the prior art, an independent structure within which the structural work supports firstly the turbine and secondly the condenser, the low-pressure module 1 comprises an outer jacket 2 known as the exhaust box. Because the pressure of the steam on the exhaust side of the low-pressure module 1 is of the order of a few tens of mbar in the operational configuration, the exhaust box 2 and the outer jacket 3 of the condenser 4 together form an evacuated space. The low-pressure module 1 also comprises, inside the exhaust box 2, an internal turbine casing 5 with two streams, which may or may not be symmetric, containing a rotor 6 equipped with moving blades and supporting fixed vanes of the low-pressure module 1.

With reference to FIG. 2, which is an exploded perspective view of the exhaust box 2 and of the internal turbine casing 5, according to an independent structure of the prior art, the exhaust box 2 comprises a front part 7 and a rear part 8. The front part 7 comprises a lower part 7A and an upper part 7B which are bolted together at a mating plane 9. The same is true of the rear part 8, which comprises a lower part 8A and an upper part 8B which are bolted together at a mating plane 10, the two mating planes 9, 10 being continuous with one another. The exhaust box 2 encompasses the internal turbine casing 5 which is made up of a central part 11 and of two exhaust ends 12, 13, one of them, 12, at the front and the other, 13, at the rear. The central part 11 of the internal turbine casing 5 is intended to support at least one set of fixed vanes and to accommodate the rotor 6 equipped with at least one set of moving blades. The steam is let into the central part 11 via at least one pipe 14. The steam is then split into a front stream and a rear stream. The two streams expand in the central part 11 of the internal turbine casing 5, to drive the rotor 6. The steam is then directed toward the two, front 12 and rear 13, exhaust ends. Bearings 15 are incorporated into said exhaust ends 12, 13 to support the rotor 6 inside the internal turbine casing 5.

The exhaust box 2 is supported by the condenser 4, while the internal turbine casing 5 is supported by a slab 16 connected to a raft foundation 17 via posts 18, said raft foundation 17 resting on the ground 19. The connection between the internal turbine casing 5 and the slab 16 is via two bearers 20, one of them secured to the front exhaust end 12 and the other to the rear exhaust end 13 of said internal turbine casing 5. Thus, the internal turbine casing 5 is decoupled from the exhaust box 2, at its mount.

Despite the benefit of making the internal turbine casing and the exhaust jacket independent of one another in the region of the mounts that support said turbine casing, notably for the reasons mentioned hereinabove, it still remains the case that the connection between said internal turbine casing and the slab, using the bearers, has to have certain properties because this connection has to prevent accidental lifting of the internal turbine casing in the event, for example, of the untimely loss of a rotor blade, which will create an out-of-balance force, causing the rotor to become unbalanced and therefore react by lifting, causing the internal turbine casing to lift in relation to the slab. In addition, this connection between the internal turbine casing and the slab has to be configured to allow said internal turbine casing to slide along the slab in order to take turbine casing expansion into consideration. Specifically, because the internal turbine casing is immobilized at its front part, it will have a tendency to expand in the region of its rear part and, in order to allow for this expansion, it is necessary to allow for said turbine casing to slide with respect to the slab.

This type of connection, between the internal turbine casing and the slab, and which meets these two requirements, is already in use, but using separate means, the one designed specifically to prevent the turbine casing from lifting and the others specifically designed to allow the internal turbine casing to slide along the slab, said means being installed beside one another in the region of this connection. These existing connections occupy a great deal of space because of these multiple different means laid out in the region of the connecting interface where the turbine casing and the slab meet, and which are positioned side by side. In addition, these separate means need to be set out relative to one another in a special and well ordered geometry so that they do not interfere with one another and do not impair the quality of the connection. Finally, adjusting these separate means to ensure a good connection between the internal turbine casing and the slab is a lengthy process because it requires two sets of intervention, one on the special-purpose means that prevent the lifting and the other on the special-purpose means that allow the sliding. The connections used in devices for steam turbines according to the invention involve connectors of just one single type, each performing both functions, that of preventing the internal turbine casing from lifting and that of allowing said turbine casing to slide along the slab. Thus, the problems associated with the use of two special-purpose connectors each one dedicated to one particular function and which have been mentioned hereinabove are solved by the single connector involved in the devices for steam turbines according to the invention.

SUMMARY

The present disclosure is directed to a module for a steam turbine, including an internal turbine casing able to accommodate at least one set of fixed vanes and a rotor equipped with at least one set of blades, and a slab. The internal turbine casing rests on the slab via at least two bearers secured to the internal turbine casing. A connection between the bearers and the slab is provided by a plurality of mechanical connectors.

The connectors each prevent the internal turbine casing from lifting in relation to the slab, and facilitate the internal turbine casing to slide on the slab.

BRIEF DESCRIPTION OF THE DRAWINGS

A detailed description of one preferred embodiment of a device for a steam turbine according to the invention is given hereinafter with reference to FIGS. 1 to 6.

For a clear understanding of the invention, and in order to provide a picture of how the figures are oriented, the axis X is a horizontal axis which is parallel to the axis of rotation of the rotor, Y is a horizontal axis perpendicular to X, and Z is a vertical axis.

DETAILED DESCRIPTION OF THE PREFERRED EMBODIMENTS

Introduction to the Embodiments

Figure 1:
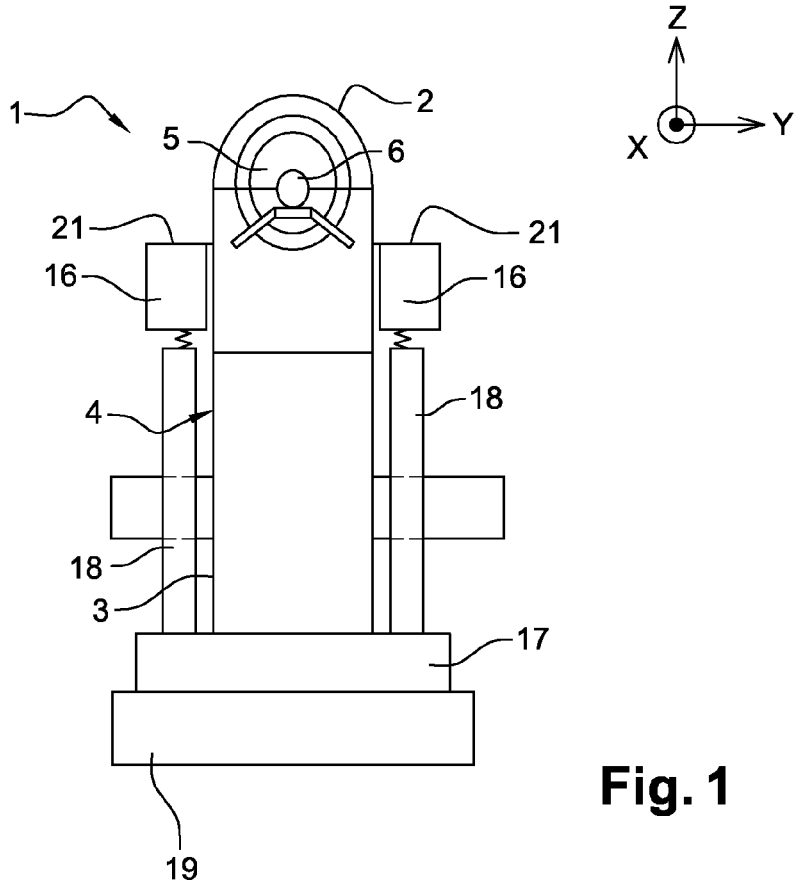
FIG. 1, which has already been described, schematically illustrates a configuration of the prior art, of the supporting structure that supports the turbo-alternator unit and the condenser, FIG. 2, which has already been described, is an exploded perspective view of the exhaust box and of the internal turbine casing according to the prior art.

In order to clarify the features of the invention, it should be specified that the bearers are secured rigidly to the internal turbine casing such that said bearers and said turbine casing experience exactly the same movements. Thus, and by way of example, the sliding of the bearers along the slab in actual fact mirrors the sliding of the internal turbine casing along the slab, via said bearers.

The subject of the invention is a module for a steam turbine, comprising an internal turbine casing able to accommodate at least one set of fixed vanes and a rotor equipped with at least one set of blades, and a slab, the internal turbine casing resting on the slab via at least two bearers secured to said turbine casing, the connection between said bearers and said slab being afforded by a plurality of mechanical connectors. The main feature of a device for a steam turbine according to the invention is that the connectors each combine two functions, one of them preventing the turbine casing from lifting in relation to the slab, and the other making it easier for said turbine casing to slide on the slab. In this way, the connectors are identical, and are repeated along the interface between the bearers and the slab, and are situated at predefined locations. They thus each contribute toward preventing the unwanted lifting of the turbine casing under the effect, for example, of the accidental loss of a rotor blade, and to easing the sliding of the turbine casing on the slab. Stated a bit more explicitly, each connector comprises a certain number of components which are arranged with respect to one another in a special way and are combined together into a unit space, to perform the two functions.

Advantageously, the connection interface between each bearer and the slab is substantially horizontal, each connector comprising a vertical rod fixed to the slab and provided with an upper end stop, each bearer resting on the slab with said rods passing through it, leaving a certain clearance along the interface plane, the end stops being positioned above each bearer. Specifically, the principle of these connectors relies on a rod which, on the one hand, will serve as a support for an end stop located above the bearer to prevent its potential lifting and, on the other hand, will serve as a positioning guide for said bearer, leaving a clearance along the horizontal interface plane so as to allow it to slide on the slab. To sum up, the connectors used in the device for a steam turbine according to the invention immobilize the internal turbine casing in a vertical direction and allow said turbine casing to move in a horizontal plane. The clearance can be likened to an empty space of reasonable dimensions.

Preferably, each connector comprises a control device secured to the slab and allowing the height of the internal turbine casing to be locally adjusted on the control devices, each bearer resting on said control devices. For this configuration, each bearer rests on the slab via a plurality of control devices. Each control device can be manipulated separately from one another in order locally to adjust the height of the internal turbine casing once the latter has been set down on said control devices via the bearers. These control devices have a dual function: they allow the position of the internal turbine casing to be adjusted heightwise with respect to the slab, and they constitute a track on which the bearer can slide with respect to the slab, to allow for any potential expansion of the internal turbine casing.

Preferably, the control device is a rotary actuator that can be actuated at the connection interface once the bearer has been set down resting against said control devices. In this way, once the bearer has been set down on said control devices, an operator can always tweak said control devices, at the interface between the bearer and the slab, to perfect the positional adjustment of the bearer with respect to the slab.

Advantageously, the contact surfaces via which the control devices make contact with the bearer are chemically treated to make it easier for the bearer to slide along said control devices. Via this configuration, the connectors are able to perform an additional function: in addition to preventing the bearer from lifting through the use of an end stop, and in addition to allowing said bearer to move along the slab by introducing a certain clearance between the bearer and each rod, it also makes said movement easier by acting as an optimized sliding track, reducing the coefficients of friction between the bearer and said control devices.

Advantageously, a spacer piece is inserted around the rod, between the slab and the end stop, each spacer piece protruding from the upper part of the bearer and each end stop being in contact with each spacer piece, a clearance along the interface plane remaining between the bearer and each spacer piece. In this way, when the bearer is resting against the slab, either directly or via the control devices, the end stops are in contact with the spacer pieces which protrude from said bearer, creating a vertical clearance between each end stop and the bearer. Preferably, each spacer piece rests against each control device, said device thus adjusting the positioning both of the bearer and of the spacer piece. It is necessary to maintain a clearance along the interface plane between each spacer piece and the bearer so that the connectors can still provide a movement of the bearer by sliding along the control device in the event of expansion of the internal turbine casing.

Preferably, each bearer has a multitude of holes, the dimensions of which exceed those of the spacer pieces, so that each hole lies around each spacer piece leaving a clearance that allows the bearer to slide along the slab, along the interface plane.

Advantageously, each rod is set in a state of tensile preload. In this way, each end stop borne by each rod under preload and immobilized thereon will offer greater resistance against potential lifting of the bearer and will be able to counteract stronger lifting forces with a greater level of safety.

Advantageously, the connection between the bearers and the slab uses means of contact the individual positions of which can be adjusted in order to increase the area of contact between the bearer and the slab. The major benefit of this increase in area of contact between the bearer and the slab is, firstly, that the forces between these two elements are more evenly distributed where they join and, secondly, that this connection becomes more rigid enabling it to limit, if not eliminate, parasitic vibration that could cause movements of the internal turbine casing and therefore malfunctioning of the steam turbine.

Preferably, the contact mechanisms are tapered shim actuators, secured to the slab, and the height of which is adjustable. The advantage of this type of actuator is that it can be operated from the interface between the bearer and the slab once the bearer is resting on said slab.

The devices for steam turbines according to the invention, which use connectors of a single and multifunction type to provide the connection between each bearer of the internal turbine casing and the slab, have the advantage of offering simplified maintenance, insofar as this maintenance now requires just one intervention on just one type of connector. In addition, the devices for turbines according to the invention have the advantage of using a connection interface for the connection between the bearers and the slab which is improved and strengthened, while at the same time remaining quick and easy to adjust, because there now remains just one single type of connector to master, rather than two types as before. Both in terms of maintenance interventions and in terms of adjustment operations, this results in a significant time saving and therefore in cost reductions.

DETAILED DESCRIPTION

Figure 2:
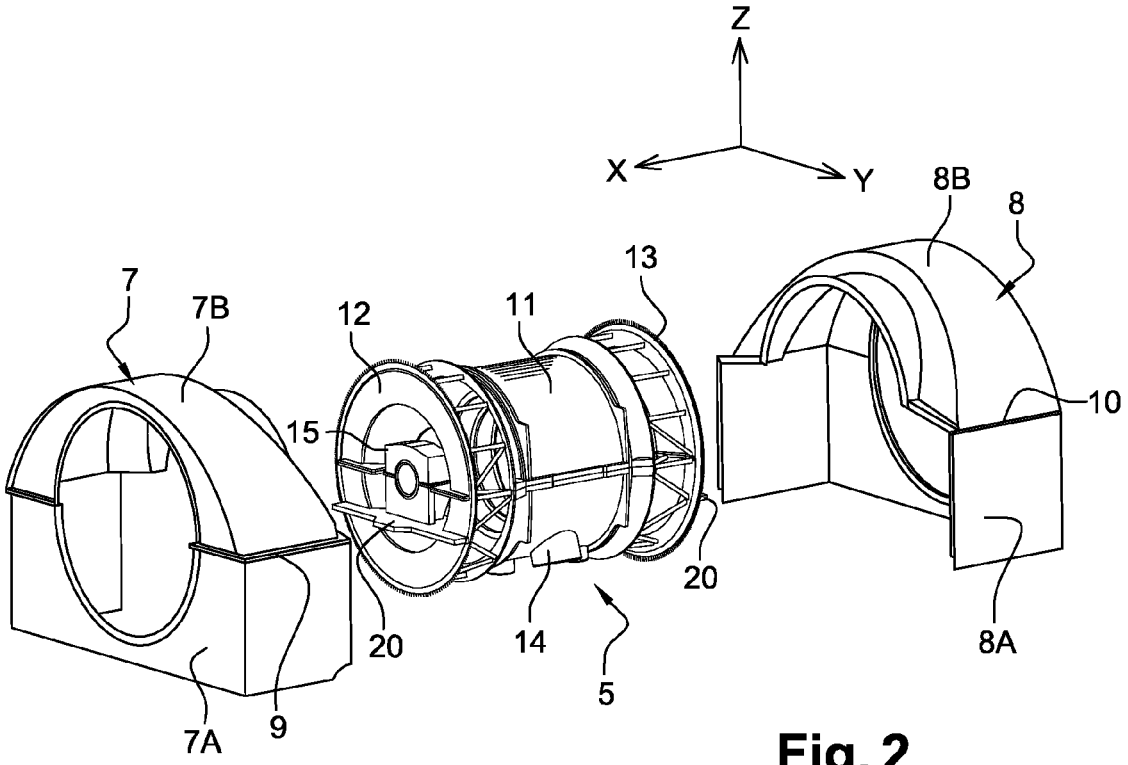
Figure 3:
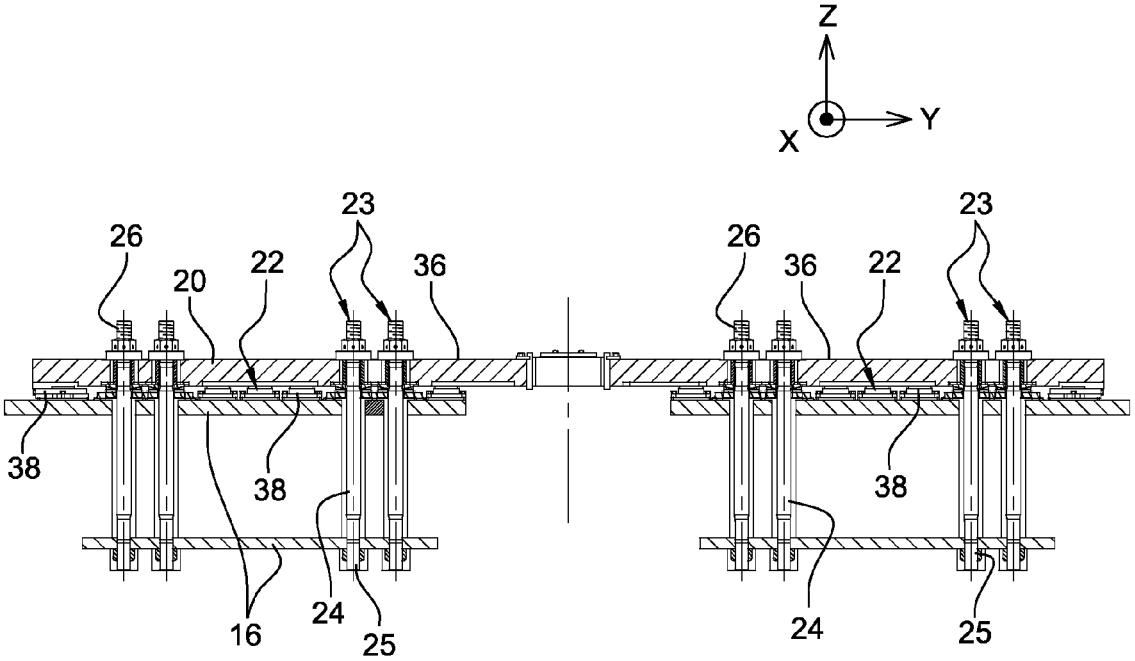
FIG. 3 is a view in cross section on axis Y of a connection interface between a bearer and the slab, of a device for a steam turbine according to the invention.

With reference to FIG. 3, in which elements identical to those of FIGS. 1 and 2 bear the same reference numerals, a device for a steam turbine according to the invention comprises an internal turbine casing 5 resting on a slab 16 via two bearers 20, one of them being secured to the front exhaust end 12 and the other to the rear exhaust end 13, the ideas of front and rear being interpreted in relation to the axis X. These bearers 20 can be likened to horizontal plates and project outward from the internal turbine casing 5, at the two exhaust ends 12, 13, the two bearers 20 being identical and aligned with one another, at the same height. The slab 16 has a flat upper surface 21 on which the two bearers 20 rest.

Throughout the remainder of the description, and to simplify the reading, just one bearer 20 is considered, it being understood that the description is just as valid in respect of the second bearer 20. Likewise, the description focuses on just one connector, even though there are several of these, this description therefore remaining valid for all the connectors, because they are identical.

The bearer 20 defines with the slab 16 a horizontal connection interface 22 involving a series of eight identical connectors 23, each one being able to perform two functions, one being that of preventing the bearer 20 from lifting off the slab 16, under the effect of an unexpected accidental event, such as the loss of a blade from the rotor 6, and the other being that of allowing the bearer 20 to slide along the slab 16, in order to absorb the effects of expansion of the internal turbine casing 5. A connector 23 comprises a rigid rod 24 which is threaded at its two ends 25, 26, the lower end 25 being screwed in to the slab 16. In other words, the rod 24 is fixed, non-removably, into the slab 16.

Figure 4:
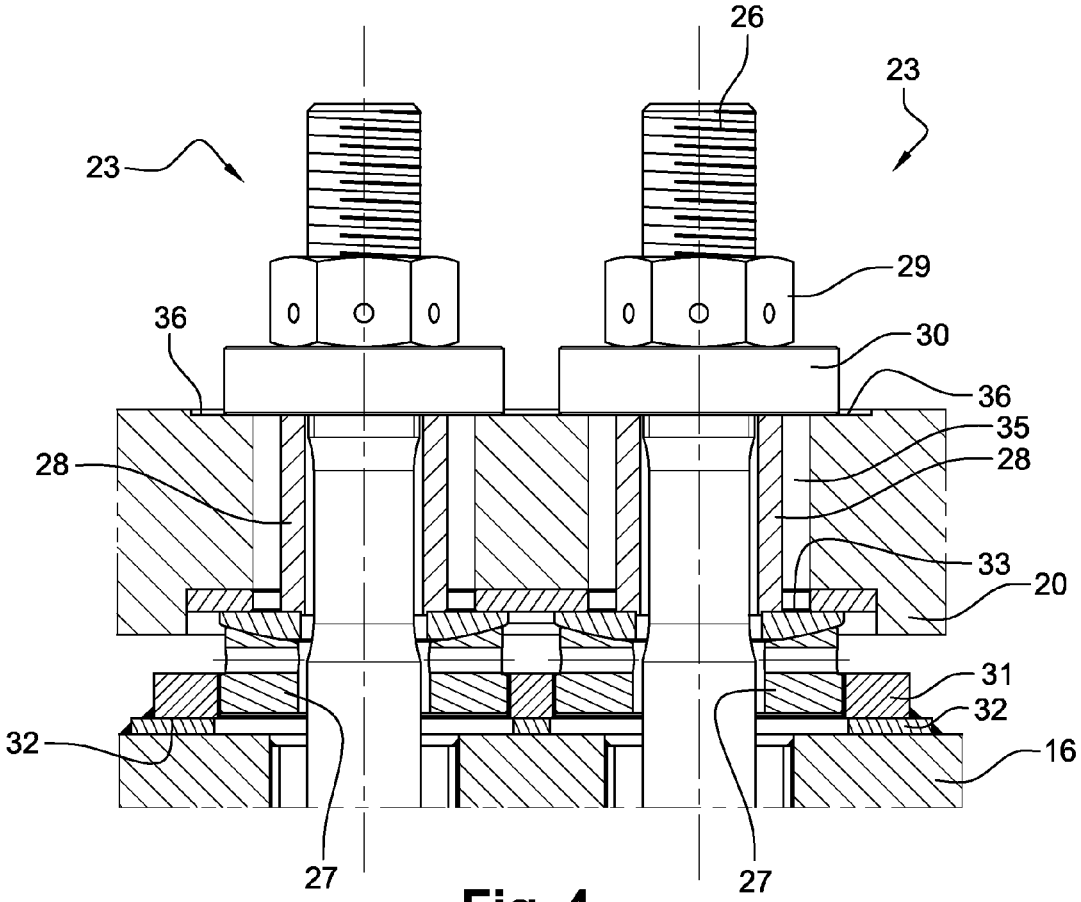
FIG. 4 is a view in cross section on axis Y, of two identical connectors used at the interface between a bearer and the slab, of a device for a steam turbine according to the invention.

With reference to FIG. 4, the connector 23 further comprises a rotary actuator 27, a spacer piece 28, a nut 29 and a thrust washer 30. The rotary actuator 27 can be likened to a cylindrical component having an internal central passage, and rests on the slab 16 via an added horizontal member 31 secured to said slab 16 by a system of shims 32. This added member 31 comprises pierced locations each designed to house a rotary actuator 27. The rotary actuator 27 has a flat and annular upper surface 33 and can be actuated by a control lever that is horizontal, and can be rotated in a horizontal plane. The spacer piece 28 comprises a hollow cylindrical component having an internal central passage, and rests on the upper surface 33 of the rotary actuator 27 so that the internal passages of said actuator 27 and of the spacer piece 28 are perfectly continuous with one another in a vertical direction. The rod 24 protrudes from the slab 16 and passes through the pierced location of the attached member 31, then the internal passage in the rotary actuator 27, and finally the internal passage through the spacer piece 28. The upper end 26 of the rod 25 projects above the spacer piece 28. The washer 30 and the nut 29 are slipped around the threaded upper end 26 of the rod 24, the tightening of the nut 29 having a tendency to push the washer 30 toward the spacer piece 28. Passing through the bearer 20 are eight identical holes which are cylindrical and aligned with one another, the locations of these holes corresponding to the locations of the eight rods 24 that protrude from the slab 16. The bearer 20 is positioned on the slab 16 in such a way that it rests on the flat upper surfaces 33 of the rotary actuators 27, with the rod 24 and the spacer piece 28 situated around said rod 24 passing through it in the region of each of its holes. The spacer piece 28 rests on the flat upper surface 33 of the rotary actuator 27, being positioned inside the hole in the bearer 20, the length of the spacer piece, considered along its axis of revolution, being greater than the thickness of said bearer 20. As a result, the upper end of the spacer piece 28 protrudes above the bearer 20 when the spacer piece 28 is resting on the control device. The diameter of the hole is greater than the outside diameter of the spacer piece 28, thus leaving a space 35 between said spacer piece 28 and the wall delimiting the hole, this space 35 extending horizontally along the interface plane 22. The flat upper surface 33 of the rotary actuator 27 is chemically treated with a view to limiting the coefficients of friction toward the bearer 20. Once the bearer 20 is correctly positioned on the slab 16, each rod 24 is stretched under tensile load along its vertical longitudinal axis in order to preload it, the nuts 29 then being tightened in order to drive the washers 30 against the spacer pieces 28. Said spacer pieces 28 protrude from the bearer 20, leaving a vertical clearance between the upper surface 36 of the bearer 20 and the upper end of each spacer piece 28. Placing each rod 24 under mechanical tension increases the ability of the limit stop formed by the washer 30 to withstand unwanted lifting of the internal turbine casing 5.

Figure 5:
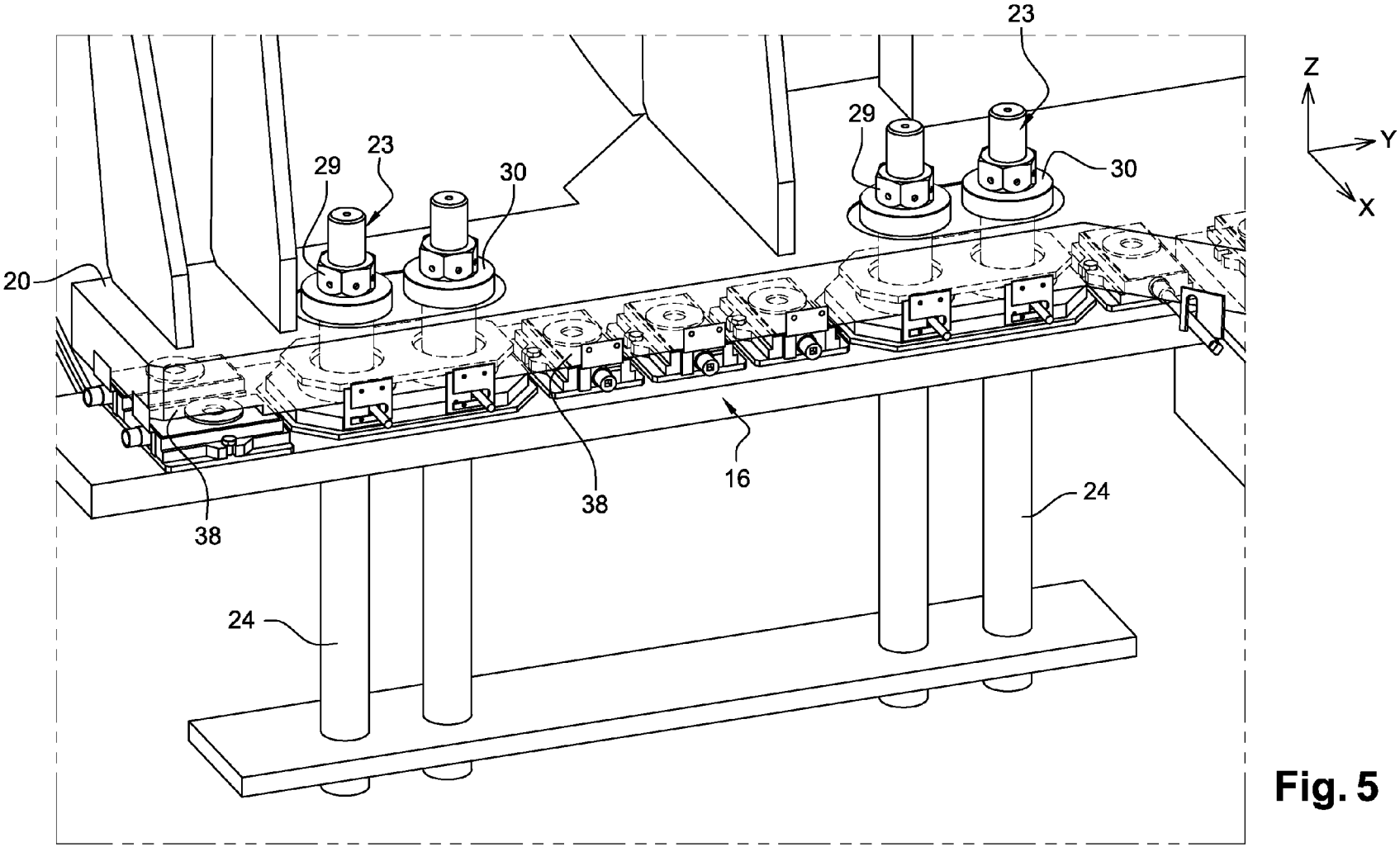
FIG. 5 is a perspective view showing half of the connection interface between a bearer and the slab, of a device for a steam turbine according to the invention.

With reference to FIG. 5, the connection interface 22 between the bearer 20 and the slab 16 is strengthened by contact mechanisms 38, which are aligned with the connectors 23, and are intended to increase the area of contact between the slab 16 and the bearers 20. These contact mechanisms comprise tapered shim actuators 38 which can be adjusted individually. The shim can either go up or down. These tapered shim actuators 38 are inserted between the connectors 23. The increase in the area of contact between the bearer 20 and the slab 16 is beneficial and particularly desirable because, on the one hand, it provides a better distribution of force between said bearer 20 and said slab 16 along the interface plane 22 and thus improves the relative sliding of these two elements 16, 20 and, on the other hand, it makes the connection between these two elements 16, 20 a little more rigid so that unwanted vibration, which likely lead to movement of the internal turbine casing 5 and therefore to turbine malfunctioning, can be absorbed.

Figure 6:
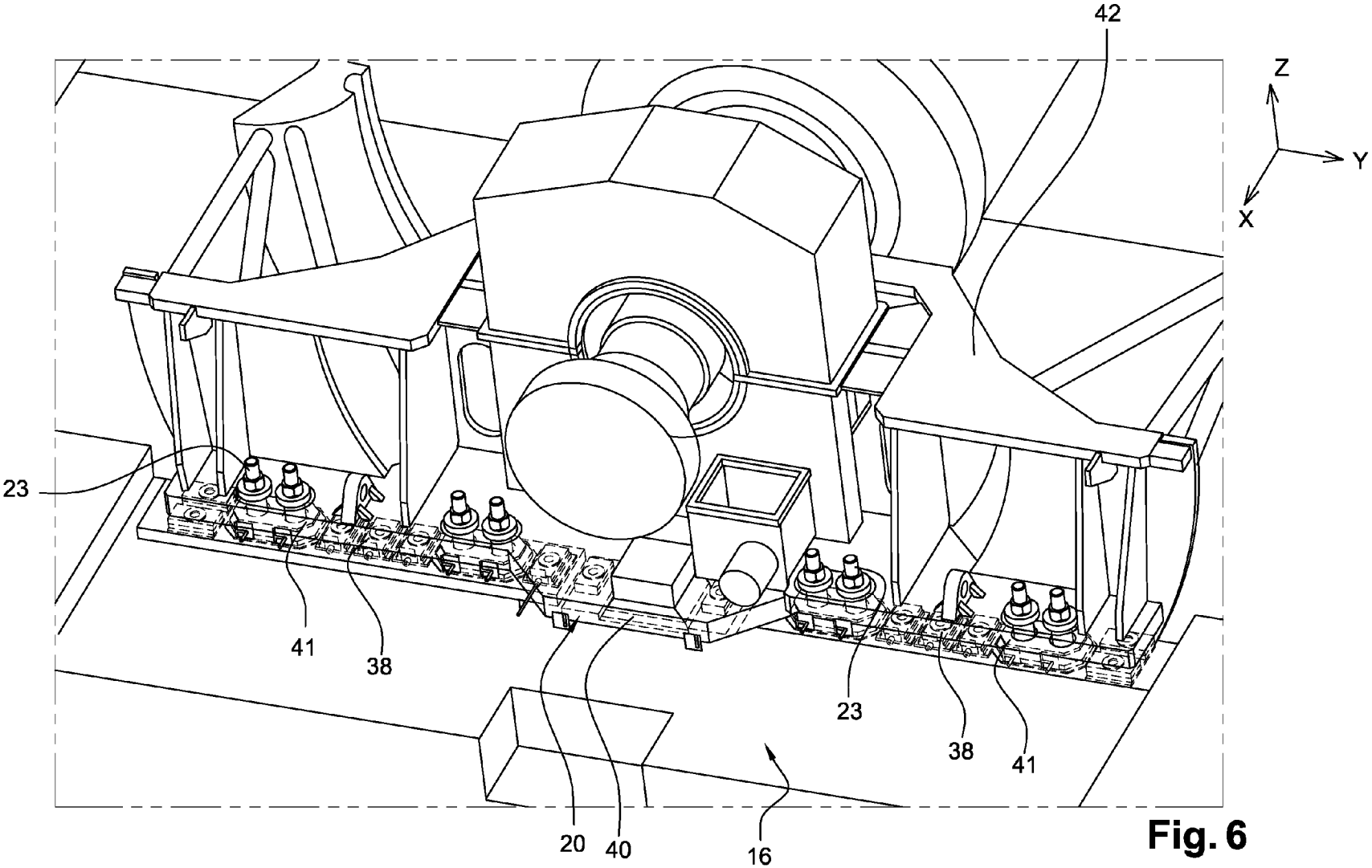
FIG. 6 is a perspective view showing all of the connection interface between a bearer and the slab, of a device for a steam turbine according to the invention.

With reference to FIG. 6, the connection between a bearer 20 and the slab 16 involves connectors 23 and contact mechanisms 38 which are distributed around these connectors 23, the connectors 23 being distributed in pairs, each pair being made up of two contiguous connectors 23. For the configuration illustrated in FIG. 7, the bearer 20 has a central preeminence 40, flanked by two lateral wings 41 which are set back from said preeminence 40. The connectors 23 are fixed in the region of said wings 41, in pairs, the preeminence 40 being provided only with means of contact 38. Each of the two wings 41 comprises two pairs of connectors 23 which are separated from one another by aligned contact mechanisms 38, the two pairs each being bounded on the outside again by contact mechanisms 38. The rotor 6 rests on a bed plate 42, which is raised up above the plane of interface 22 between the bearer 20 and the slab 16.

With a view to reinstating the functions of the various components involved and the order in which they are used, a method of resting an internal turbine casing 5 on a slab 16 follows the following steps:

fixing the connectors 23 and the rods 24 into the slab 16, arranging the internal turbine casing 5 on the slab 16 such that the rods 24 fixed into said slab 16 pass through the two bearers 20, at the locations provided for that purpose, each bearer 20 resting on the rotary actuators 27 and on the means of contact 38, tweaking the rotary actuators 27 in order locally to adjust the correct positioning of the bearer 20, subsequently placing the spacer pieces 28, over the rotary actuators 27, tweaking the tapered shim actuators 38 to ensure that the load is uniformly distributed over all the rotary actuators 27 and all the tapered shim actuators 38, stretching the rods 24 to place them under tensile stress and are then set in that condition, tightening the nuts 29 in order to bring the washers 30 down against the spacer pieces 28.

What is claimed is:

1. A module for a steam turbine, comprising:

an internal turbine casing able to accommodate at least one set of fixed vanes and a rotor equipped with at least one set of blades, and a slab, the internal turbine casing having at least two bearers that directly rest on the slab obtaining a direct and single phase horizontal connection interface between the bearers and the slab, the connection interface between said bearers and the slab being provided by a plurality of mechanical connectors, wherein the connectors each prevent the internal turbine casing from lifting in relation to the slab, and facilitate said internal turbine casing to slide on the slab.

2. The module as claimed in claim 1, wherein a connection interface between each bearer and the slab is substantially horizontal, each connector comprising a vertical rod fixed to the slab and provided with an upper end stop, each bearer resting on the slab (16) with said rods (24) passing through it, leaving a certain clearance along a plane of the interface, the end stops being positioned above each bearer.

3. The module as claimed in claim 2, wherein each connector comprises a control device secured to the slab and allowing a height of the internal turbine casing to be locally adjusted on the control devices, each bearer resting on the control devices.

4. The module as claimed in claim 3, wherein the control device is a rotary actuator that can be actuated at the connection interface once the bearer has been set down resting against said control devices.

5. The module as claimed in claim 3, wherein contact surfaces via which the control devices make contact with the bearer are chemically treated to reduce a coefficient of friction between the bearers and said controls devices, and which facilitates sliding of the bearer (20) along said control devices.

6. The module as claimed in claim 2, wherein a spacer piece is inserted around the rod, between the slab and the end stop, each spacer piece protruding from the upper part of the bearer, and wherein each end stop (30) is in contact with each spacer piece, a clearance along the interface plane remaining between the bearer and each spacer piece.

7. The module as claimed in claim 6, wherein each bearer has a multitude of holes, the dimensions of which exceed those of the spacer pieces, so that each hole lies around each spacer piece leaving a clearance that allows the bearer to slide along the slab, along the interface plane.

8. The module as claimed in claim 2, wherein each rod is set in a state of tensile preload.

9. The module as claimed in claim 1, wherein the connection between the bearers and the slab uses contact mechanisms the individual positions of which can be adjusted in order to increase the area of contact between the bearer and the slab.

10. The module as claimed in claim 9, wherein the contact mechanisms are tapered shim actuators, secured to the slab, and a height of which is adjustable.

11. A module for a steam turbine, comprising:

an internal turbine casing configured to accommodate at least one set of fixed vanes and a rotor equipped with at least one set of blades;

at least two bearers secured to the internal turbine casing, the at least two bearers including at least one bearer secured to a front exhaust end of the internal turbine casing and at least one bearer secured to a rear end of the internal turbine casing;

a slab; and wherein the internal casing rests directly on the slab via a horizontal connection interface between the at least two bearers and the slab, and wherein the slab is secured to each of the at least two bearers by a plurality of mechanical connectors, each mechanical connector having vertical rod fixed to the slab for preventing the internal turbine casing from lifting in relation to the slab, and wherein each of the mechanical connectors includes an upper end stop, leaving a clearance along the connection interface, the end stops being position above the bearer, and wherein the clearance and the end stop enable the internal casing to slide on the slab.

12. The module as claimed in claim 11, wherein each connector comprises:

a control device secured to the slab, and wherein each of the at least two bearers rests on the control devices.

13. The module as claimed in claim 12, wherein the control device is a rotary actuator that can be actuated at the connection interface once the bearer has been set down resting against said control devices, and wherein the control device enable a height of the internal turbine casing to be locally adjusted on the control devices.

14. The module as claimed in claim 11, wherein a spacer is inserted around the rod, between the slab and the end stop, each spacer protruding from the upper part of the bearer, and wherein each end stop is in contact with each spacer, a clearance along the interface plane remaining between the bearer and each spacer; and wherein each bearer has a multitude of holes, the dimensions of which exceed those of the spacers, so that each hole lies around each spacer leaving a clearance that allows the bearer to slide along the slab, along the interface plane.

15. The module as claimed in claim 11, wherein each rod is set in a state of tensile preload.

16. The module as claimed in claim 11, wherein the connection between the bearers and the slab uses contact mechanisms the individual positions of which can be adjusted in order to increase the area of contact between the bearer and the slab, and wherein the contact mechanisms are tapered shim actuators, secured to the slab, and a height of which is adjustable.

17. The module as claimed in claim 11, wherein the plurality of mechanical connectors are arranged in pairs, each of the pairs including two contiguous mechanical connectors.

18. The module as claimed in claim 17, wherein each of the bearers includes a central preeminence flanked by two lateral wings, and each of the two lateral wings is secured to the slab via two pairs of mechanical connectors.

19. The module as claimed in claim 18, wherein each of the two pairs of mechanical connectors are separated from one another by an aligned contact mechanism.

20. A module for a steam turbine, comprising:

an internal turbine casing configured to accommodate at least one set of fixed vanes and a rotor equipped with at least one set of blades, and a slab, the internal turbine casing having at least two bearers that directly rest on the slab obtaining a direct horizontal connection interface between the bearers and the slab, the connection interface between said bearers and the slab including a plurality of mechanical connectors, wherein each of the connectors prevent the internal turbine casing from lifting in relation to the slab and facilitate said internal turbine casing to slide on the slab.

* * * * *